US007357831B2

(12) United States Patent
Dancey et al.

(10) Patent No.: US 7,357,831 B2
(45) Date of Patent: Apr. 15, 2008

(54) METHOD AND APPARATUS FOR CONTROLLING HUMIDITY AND MOLD

(75) Inventors: Larry Dancey, Melfort (CA); Claude Bourgault, St. Brieux (CA)

(73) Assignee: Dryair Inc., Saskatchewan (CA)

( * ) Notice: Subject to any disclaimer, the term of this patent is extended or adjusted under 35 U.S.C. 154(b) by 320 days.

(21) Appl. No.: 10/751,455

(22) Filed: Jan. 6, 2004

(65) Prior Publication Data

US 2005/0145109 A1 Jul. 7, 2005

(51) Int. Cl.
*B01D 47/06* (2006.01)
*B01D 50/00* (2006.01)

(52) U.S. Cl. ..... 96/400; 55/318; 55/356; 55/385.2; 55/472; 95/10; 95/15; 95/22; 95/214; 95/273; 454/66; 454/238

(58) Field of Classification Search ..... 55/318, 55/356, 385.2, 472, 382.5; 95/10, 15, 22, 95/214, 273; 96/400; 454/66, 238
See application file for complete search history.

(56) References Cited

U.S. PATENT DOCUMENTS 4,968,333 A * 11/1990 Ellis et al. ..... 55/341.1
5,004,483 A * 4/1991 Eller et al. ..... 95/10
5,660,048 A * 8/1997 Belding et al. ..... 62/94
5,944,894 A * 8/1999 Kitano et al. ..... 118/326
5,960,556 A 10/1999 Jansen
6,022,389 A * 2/2000 Vross et al. ..... 55/315.1
6,432,204 B1 * 8/2002 Ueda ..... 118/667
6,641,635 B1 * 11/2003 Chiesl ..... 55/385.2
6,647,639 B1 11/2003 Storrer
2004/0020363 A1 * 2/2004 LaFerriere et al. ..... 95/273
2005/0132681 A1 * 6/2005 Chu ..... 55/471

* cited by examiner

*Primary Examiner*—Duane Smith
*Assistant Examiner*—Minh-Chau T. Pham
(74) *Attorney, Agent, or Firm*—Nixon & Vanderhye P.C.

(57) ABSTRACT

An apparatus for reducing a relative humidity of air inside an enclosed space includes a portable outside air heat exchanger unit having a fan operative to create an air stream by drawing outside air from an intake and discharging the air stream through an outlet inside the enclosed space, and a temperature adjusting element located in the air stream. A heating source supplies heat energy to the temperature adjusting element in response to directions from a heat controller. A humidity sensor is operative to sense the relative humidity of the air in a sensing location and to send a humidity signal to the heat controller to change the amount of heat energy supplied to the temperature adjusting element in response to the humidity signal. HEPA filters and ultra-violet lights can shine on the air stream to kill mold spores and the like.

30 Claims, 3 Drawing Sheets

METHOD AND APPARATUS FOR CONTROLLING HUMIDITY AND MOLD

This invention is in the field of controlling the condition of air in buildings and like enclosed spaces, and in particular control of humidity and also micro-organisms, spores and the like in the enclosed space.

BACKGROUND

It is well known that excessive moisture in buildings causes considerable problems. Drywall and flooring absorb moisture and are readily damaged if the excessive moisture condition persists for any length of time. Interior elements such as insulation, studs, and joists can eventually be affected as well. Furthermore, mold begins to form on the damp building materials, and can remain in the structure even after it has dried, causing breathing problems for persons occupying the building.

At the extreme, such excessive moisture conditions are exemplified by a flooded building. U.S. Pat. No. 6,457,258 to Cressy et al., "Drying Assembly and Method of Drying for a Flooded Enclosed Space", discloses an apparatus for drying flooded buildings that overcomes problems in the prior art. Such prior art is said to require stripping wall and floor coverings and using portable dryers to circulate air to dry out the exposed floor boards, joists and studs. The methods were slow and allowed mold to form on the interior framing, which could then go unnoticed and be covered up and then later present a health hazard to occupants.

The solution proposed by Cressy is to introduce very hot and dry air into the building, indicated as being at 125° F. and 5% relative humidity, in order to dry the building very quickly to prevent mold growth and allow an early return to occupants. In the apparatus of Cressy et al., outside air is heated by a furnace and the heated air is blown into the building where it picks up moisture and then is exhausted back outside. In Cressy heat from the warmer exhaust air is transferred to the cooler outside air prior to heating by the furnace, thereby increasing the efficiency of the system.

U.S. Pat. No. 6,647,639 to Storrer, "Moisture Removal System", addresses the problem of extracting water promptly to prevent the formation of rot, mold, rust and the like in flooded buildings. Storrer reveals the prior art as including passive drying through opening windows, etc. and active drying using forced air (heated or not) to expedite evaporation. Storrer discloses using a blower to blow (or draw) dry air through a hose and manifolds that can be directed at a particular area that it is desired to dry.

In a similar vein, U.S. Pat. No. 5,960,556 to Jansen, "Method for Drying Sheathing in Structures", is directed to drying walls with warm, low humidity air.

Prior art systems for drying flooded buildings also include dessicant dehumidifiers that use a desiccant material with a high affinity to water to absorb water from the air, and refrigerant dehumidifiers that condense water out of the air by cooling it. In both of these systems, the water must be disposed of in some manner. The water absorbed by the dessicant material is removed by subsequently drying the material. The water condensed by the refrigerant system is collected in a reservoir that must be emptied from time to time or piped to a disposal area. Care must be taken that the collected water be removed so that mold does not form therein and disperse within the building.

While flooded buildings demonstrate an extreme situation, excessive moisture also causes problems in other situations as well. During construction wet conditions are often present in buildings. Long periods of rain during construction, burst pipes, wet building materials (such as concrete), and like conditions can contribute to humid conditions where excessive moisture can be absorbed by joists and studs. These moist members are often covered up by flooring and drywall such that drying is prevented, and rot, mold, and the like can form.

In cold climates it is also common to use construction heaters to warm buildings during construction. Such heaters that use combustion inside the building also cause a significant increase in the humidity of the air inside the building, contributing to excessive moisture inside walls and floors and the problems associated therewith.

Once the building is completed the problems remain. Mold formed inside the walls and floors can grow and cause health problems for occupants. Rot can continue once started and cause premature structural failure.

The opposite condition of excessively dry air in a building can cause problems as well. Excessively dry air can draw moisture out of wood causing warping and splitting of floors and millwork.

SUMMARY OF THE INVENTION

It is an object of the present invention to provide a method and apparatus for controlling the condition of air in enclosed spaces that overcomes problems in the prior art. It is a further object of the present invention to provide such a method and apparatus that controls the relative humidity in the enclosed space by varying the temperature of outside air drawn into the enclosed space.

It is a further object of the present invention to provide such a method and apparatus that filters the air being drawn into the building using HEPA (High Efficient Particulate Attenuation) filters to remove mold spores and micro-organisms that can be hazardous to health. It is a further object of the present invention to provide such a method and apparatus that similarly filters the air inside the building, and that further uses ultra-violet light to kill mold spores and the like.

The present invention provides, in a first embodiment, a method of reducing a relative humidity of inside air inside an enclosed space. The method comprises drawing outside air from outside the enclosed space to create an air stream discharging into the enclosed space; allowing an amount of air substantially corresponding to the air stream to escape from the enclosed space; sensing the relative humidity of the air in at least one sensing location; and in response to the relative humidity sensed at the at least one sensing location, raising a temperature of the outside air drawn in as required to lower the relative humidity of the air stream such that the relative humidity of the inside air is substantially maintained at a desired relative humidity.

The present invention provides, in a second embodiment, an apparatus for reducing a relative humidity of inside air inside an enclosed space. The apparatus comprises a portable outside air heat exchanger unit comprising a fan operative to create an air stream by drawing air from an intake and discharging the air through an outlet and a temperature adjusting element located in the air stream. The intake is adapted to draw air from outside the enclosed space and the outlet is adapted to discharge the air stream into the enclosed space. The apparatus further comprises a heating source connectable to the heat exchanger unit and operative to supply heat energy to the temperature adjusting element in response to directions from a heat controller and at least one humidity sensor operative to sense the relative humidity of the air in a sensing location and to send a humidity signal to the heat controller. The heat controller is operative to receive the humidity signal and change the amount of heat energy supplied to the temperature adjusting element in response to the humidity signal.

The present invention provides, in a third embodiment, an apparatus for drying and scrubbing inside air inside an enclosed space. The apparatus comprises a portable heat exchanger unit comprising a fan operative to create an air stream by drawing air from an intake and discharging the air through an outlet; a temperature adjusting element located in the air stream; a HEPA filter capable of High Efficient Particulate Attenuation located such that the air stream passes through the HEPA filter; and a coarse filter located upstream from the HEPA filter such that the air stream passes through the coarse filter prior to passing through the HEPA filter. A heating source is connectable to the heat exchanger unit and is operative to supply heat energy to the temperature adjusting element.

Raising the temp of air 10° C. will reduce the relative humidity of the air by about 50%. By sensing the relative humidity of the air at a sensing location at the air intake, the air stream outlet, somewhere inside the enclosed space, or at a combination of locations, a heat controller can be operated to supply heat at the proper rate to achieve a desired relative humidity in the air stream, and thus in the enclosed space.

The relative humidity of the air is an indicator of how much water the air is holding, and thus how much more water it can hold. For example, in a closed room with standing water on the floor, the relative humidity would approach 100% (i.e. the air would become saturated with water) and so no more water would evaporate off the floor. Raising the air temp 10° C. will reduce the relative humidity by 50%, resulting in a humidity gradient between the water and the air, and thus more water will evaporate off the floor and the relative humidity will again rise to 100%, provided no air moves in or out of the room. By bringing in a dryer air stream and thereby pushing the wet air out of the room through an exhaust, the water is literally carried out of the room by the exhaust air with the result that all the water will eventually evaporate and be carried out of the room.

By sensing relative humidity and controlling the temperature of the air stream in response to the relative humidity, the invention can be used to control the relative humidity in an enclosed space, thereby providing drying at a fast rate in a flooded space for example, or maintaining the relative humidity in a building under construction at a desired level.

On a wet day for example if the outside air has a relative humidity of 100%, raising the temperature of the outside air by 20° C. will reduce the relative humidity of the air stream to 25%. A relative humidity of 25% would be generally accepted to be desirable for a construction site, being neither too moist and thus promoting mold growth, nor too dry such that sensitive materials such as flooring and millwork would be adversely affected.

Alternatively raising the temperature of the outside air by 40° C. will reduce the relative humidity of the air stream to about 6% and provide fast drying in a flooded building, where damage to sensitive materials is not an issue.

The amount of heat required to achieve the desired temperature rise will depend on the volume of air drawn into the air stream, which could be varied by increasing or decreasing the fan speed. In any event, the relative humidity could be sensed at the air outlet, and the amount of heat supplied could then be varied to achieve the desired relative humidity at the output. Alternatively, the humidity and temperature could be sensed at the intake, and the temperature sensed at the outlet. The required adjustment in the amount of heat supplied could be calculated, given the relative humidity of the outside air being drawn in, by determining the temperature rise required to achieve the desired relative humidity of the air stream at the outlet.

Depending on the volume of the air stream and the size of the enclosed space, the relative humidity of the air inside the enclosed space will be reduced over some period of time as the dryer air stream pushes wetter air from inside the enclosed space out through open windows, doors, exhaust vents, or the like. The relative humidity of the inside air could also be sensed directly to control the temperature rise supplied by the heat source. Care should be taken however, since using such a direct control in a relatively large enclosed space could result initially in over drying of the air stream that could adversely affect materials near the outlet of the air stream.

HEPA filtration may be added to the heat exchanger unit such that air drawn in is filtered to remove mold spores, bacteria, and the like. Prior art apparatuses for drying flooded buildings only provide a fast drying process to prevent growth of mold and the like, but do not provide any way to purify the air. The present invention could be used to simultaneously dry and scrub the air in an enclosed space, attaining substantial efficiencies by creating a single air stream, and both heating and scrubbing the air in the air stream.

The present invention with a HEPA filter could be used to re-circulate inside air through the filters, or to filter outside air before it enters the enclosed space. In many climates, mold spores are quite prevalent in the atmosphere, and substantially removing them from the air during construction of a building would significantly reduce the risk that mold would form on the construction materials and cause later health problems to occupants. Adding an ultra-violet light to shine on and irradiate the air stream would further purify the air.

In cold weather, maintaining a desired relative humidity inside a building under construction could be accomplished by providing one or more heat exchanger units drawing in outside air and drying it to a desired relative humidity, and if necessary to maintain a desired temperature, further heat exchanger units could be provided that re-circulated inside air, adding heat as required to maintain the desired temperature. The relative humidity of the inside air depends on its temperature and could be accomplished by coordinated control of the heat exchanger units drawing from both outside and inside the enclosed space.

In hot climates, it would be possible to dry building interiors under construction after hours when they are unoccupied by introducing a heated air stream with reduced relative humidity compared to that of the atmosphere. By drying the interior overnight, and with the addition of HEPA filtration and ultra-violet light, mold growth would be significantly reduced. The heat exchanger unit could be configured to also cool the air stream, such that the interior of the building could also be cooled prior to work commencing.

In some applications, such as military camps, it is necessary to heat or cool the air inside air in a plurality of tents or such temporary structures. The present invention could readily accomplish this goal by providing a heating/cooling source connectable to supply a plurality of heat exchanger units located in the temporary structures. In addition the air inside the structures could be scrubbed to remove microorganisms for biological warfare, such as anthrax bacteria and spores, that might be used in an attack. Outside air could be drawn in through the HEPA filters and irradiated with ultra-violet light, thereby removing a very high proportion of the micro-organisms, and pressurizing the interior of the structure. With positive pressure on the interior, contaminated outside air is substantially prevented from entering the structure. Further heat exchanger units could be used in the interior to further purify the inside air.

The apparatus of the invention could be used to "recondition" a structure on a room by room basis as well, where the outside air is outside the room, and the inside air is inside the room. In addition to micro-organisms causing mold, rot, and the like, asbestos and similar undesirable particles could similarly be removed from the air inside a building.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
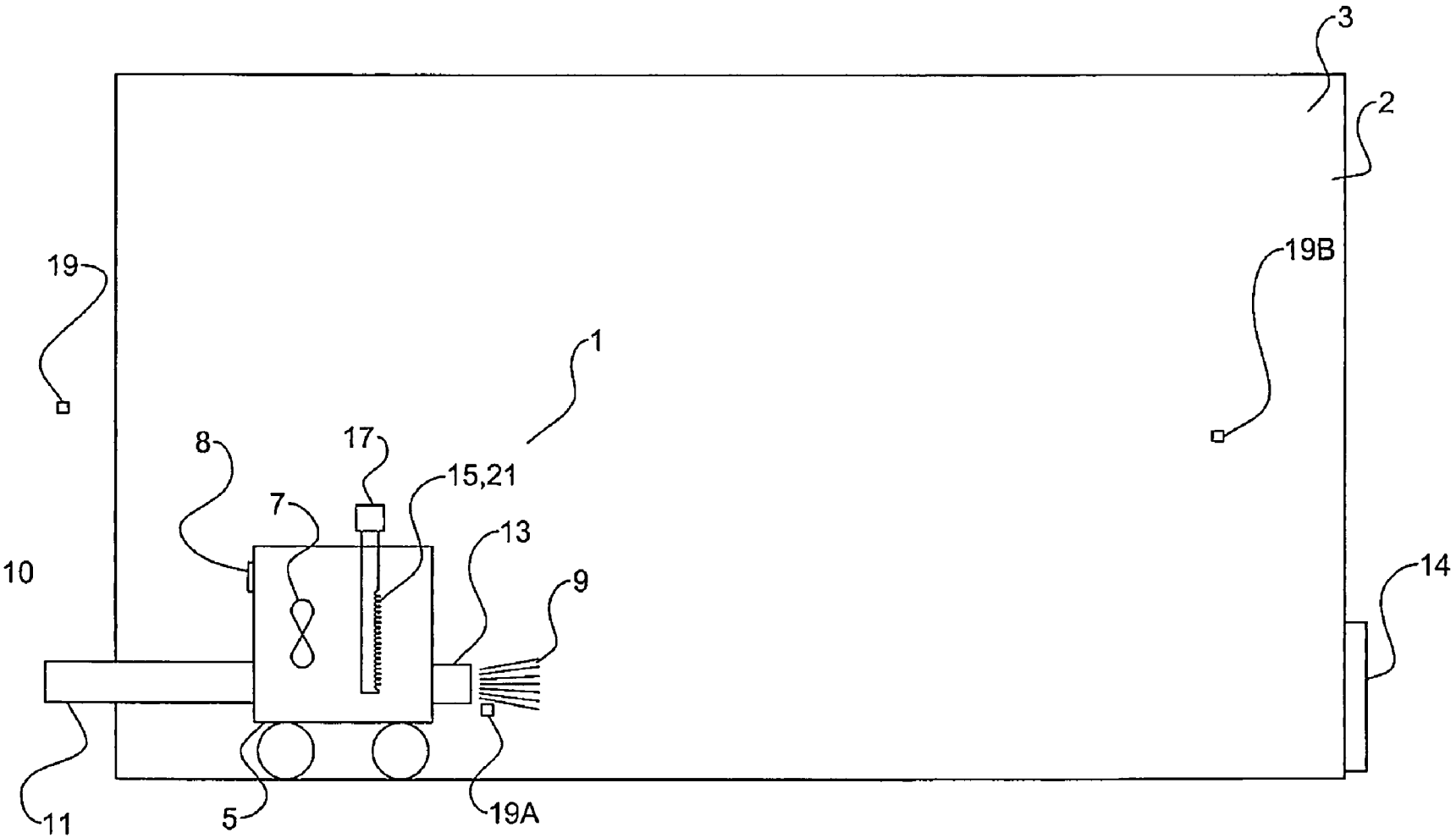
FIG. 1 is a schematic side view of an embodiment of the invention set up in an enclosed space.

FIG. 1 schematically illustrates an apparatus 1 for reducing a relative humidity of inside air 2 inside an enclosed space 3. The apparatus 1 comprises a portable outside air heat exchanger unit 5 comprising a fan 7 operative to create an air stream 9 by drawing air from an intake 11 and discharging the air through an outlet 13. The intake 11 is adapted to draw outside air 10 from outside the enclosed space 3 and the outlet 13 is adapted to discharge the air stream 9 into the enclosed space 3. The outside air heat exchanger unit 5 is illustrated located inside the enclosed space 3, with the intake 11 located outside, however alternatively the outside air heat exchanger unit 5 could be located outside with the outlet 13 located inside the enclosed space 3. Portability is provided by wheels or the like as illustrated.

The outside air heat exchanger unit 5 further comprises a temperature adjusting element 15 located in the air stream 9. A heating source is connectable to the heat exchanger unit 5 to supply heat energy to the temperature adjusting element 15 in response to directions from a heat controller 17. A humidity sensor 19 is operative to sense the relative humidity of the air in a sensing location and to send a humidity signal to the heat controller 17 through a signal line, wireless connection, or the like. The heat controller 17 is operative to receive the humidity signal and change the amount of heat energy supplied to the temperature adjusting element 15 in response to the humidity signal.

The sensing locations can be located to sense the relative humidity of the outside air, illustrated at 19, the relative humidity of the air stream 9, illustrated at 19A, or the relative humidity of the inside air 2 at a location remote from the air stream 19B.

Raising the temp of air 10° C. will reduce the relative humidity of the air by about 50%. By sensing the relative humidity of the air at a sensing location 19A at the outlet 13 of the air stream 9 the heat controller 17 can be operated to supply heat at the proper rate to achieve the desired relative humidity in the air stream 9, and thus in the enclosed space 3.

Alternatively, temperature sensors could be provided and the humidity and temperature could be sensed at the intake 11, and the temperature of the air stream 9 sensed at the outlet 13. The required adjustment in the amount of heat supplied could be calculated, given the relative humidity of the outside air 10 being drawn in, by determining the temperature rise required to achieve the desired relative humidity of the air stream 9 at the outlet.

Alternatively again the humidity can be sensed inside at the sensing location of the humidity sensor 19B. With just this measurement the temperature adjusting element 15 could initially operate at its maximum level with the result that the relative humidity of the air stream 9 could be very low initially and could damage sensitive materials adjacent to the outlet 13. In any event, sensing the relative humidity allows the apparatus 1 to operate to reduce the relative humidity of the inside air 2 in the enclosed space 3

In the embodiment of FIG. 1, the temperature adjusting element 15 comprises an electric heating element 21 and the heating source is an electrical power outlet connectable to the electric element by a power cord in a conventional manner. The apparatus 1 includes a fan controller 8 operative to change the speed of the fan 7 to vary the volume of air in the air stream 9. The fan controller can be manually controlled, or connected to receive the humidity signal, temperature signals or the like and programmed to vary the fan speed in response to information received. Thus both the volume and relative humidity of the air stream 9 can be varied in response to the humidity signal. Where drying is required it will be desired to move large volumes of dryer air into the enclosed space 3 and thus push similar volumes of wetter air out through an exhaust port 14, which could be a door, window, or the like. Where considerable drying is not required, and it is necessary to just maintain the relative humidity in the enclosed space 3, the volume of outside air drawn in can be reduced.

Figure 2:
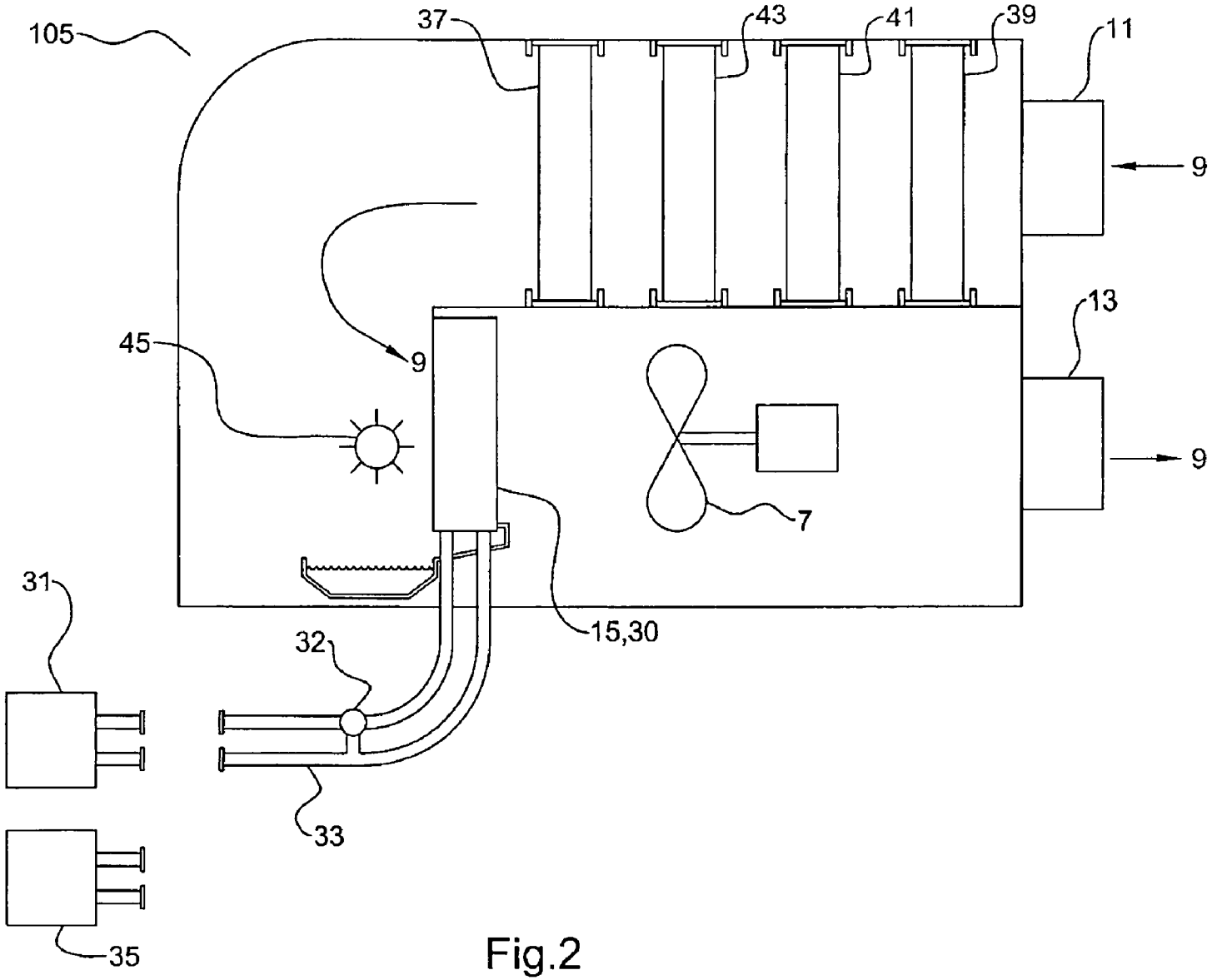
FIG. 2 is a schematic side view of an alternate heat exchanger unit of the invention.

FIG. 2 illustrates an alternate embodiment of a heat exchanger unit 105 wherein the temperature adjusting element 15 comprises a fluid coil 30 and wherein the heating source is a fluid heater 31 connectable to the fluid coil 30 by conduits 33 such that heated fluid flows from the fluid heater 31 through the fluid coil 30 and back to the fluid heater 31. The fluid heater 31 could conveniently be a boiler system set up at a central location outside so that combustion in the system does not affect the inside air. The boiler system could be made connectable to a plurality of heat exchanger units.

A fluid cooler 35 using refrigerant or the like to cool the fluid could also be provided that was in a similar manner connectable to the fluid coil 30 by conduits 33 such that cooled fluid flows from the fluid cooler 35 through the fluid coil 30 and back to the fluid cooler 35 in response to directions from a cooling controller. Thus the fluid coil 30 illustrated can be connected to heat or cool the air entering the intake 11. The flow of heated or cooled fluid through the fluid coil 30 is controlled by a heat controller 32 that can be operated manually, or that can control the flow in response to signals from humidity, temperature, an like sensors.

The heat exchanger unit 105 includes a HEPA filter 37 capable of High Efficient Particulate Attenuation located such that the air stream 9 passes through the HEPA filter 37. Suitable filters are capable of removing 99.97% of mold or any other air borne particles as small as 0.3 microns in diameter at the rated airflow. Manufacturers of certified HEPA filters will list the maximum design airflow for each size they offer. For example one available 24"×12"×12" filter is rated for a maximum of 855 cubic feet per minute (cfm), and a 24"×24"×12" filter is rated for a maximum of 1900 cfm.

The heat exchanger unit 105 includes coarse filters 39, 41 located upstream from the HEPA filter 37 such that the air stream passes through the coarse filters 39, 41 and is pre-filtered prior to passing through the HEPA filter 37. A typical pre-filtration process could be in two stages whereby the air stream 9 first passes through a rough, "loose-media" filter 39 followed by a pleated filter 41 with a MERV (minimum efficiency reporting value) of "8" by ASHRAE Standard 52.2. By changing the coarse filters 39, 41 regularly, the life of the more costly HEPA filter 37 can be prolonged.

The heat exchanger unit 105 also includes an activated carbon filter 43 located upstream from the HEPA filter 37 such that the air stream passes through the activated carbon filter 43 prior to passing through the HEPA filter 37. Such activated carbon filters will adsorb most airborne gases and odours.

Yet further the illustrated heat exchanger unit 105 also includes an ultra-violet light 45 oriented to irradiate the air stream 9 after the air stream 9 has passed through the HEPA filter. The ultra-violet rays are able to kill a significant proportion of most typical bacteria. The ultra-violet light 45 in combination with the HEPA filter 37 removes a very high proportion of micro-organisms, spores, bacteria and the like, as well as other undesirable particles, from the air stream 9.

Thus the heat exchanger unit 105 has the capability of scrubbing as well as heating or cooling the intake air. The HEPA filter 37 will remove a very high percentage of mold spores, bacteria, and other undesirable particles. In contrast to the prior art systems for drying flooded buildings which controlled mold only by drying very quickly, the apparatus of the present invention can be used to dry at a controlled rate to reduce damage to sensitive materials, while at the same time removing mold spores from outside air drawn into the building, or from the inside air as well. In buildings under repair or construction, removing mold spores can greatly reduce the risk of mold forming and persisting after the building is occupied.

Use of the activated carbon filter 43 will also remove a high proportion of airborne fumes and odors, such as can be present due to carpet adhesive, paint, and like construction materials.

Figure 3:
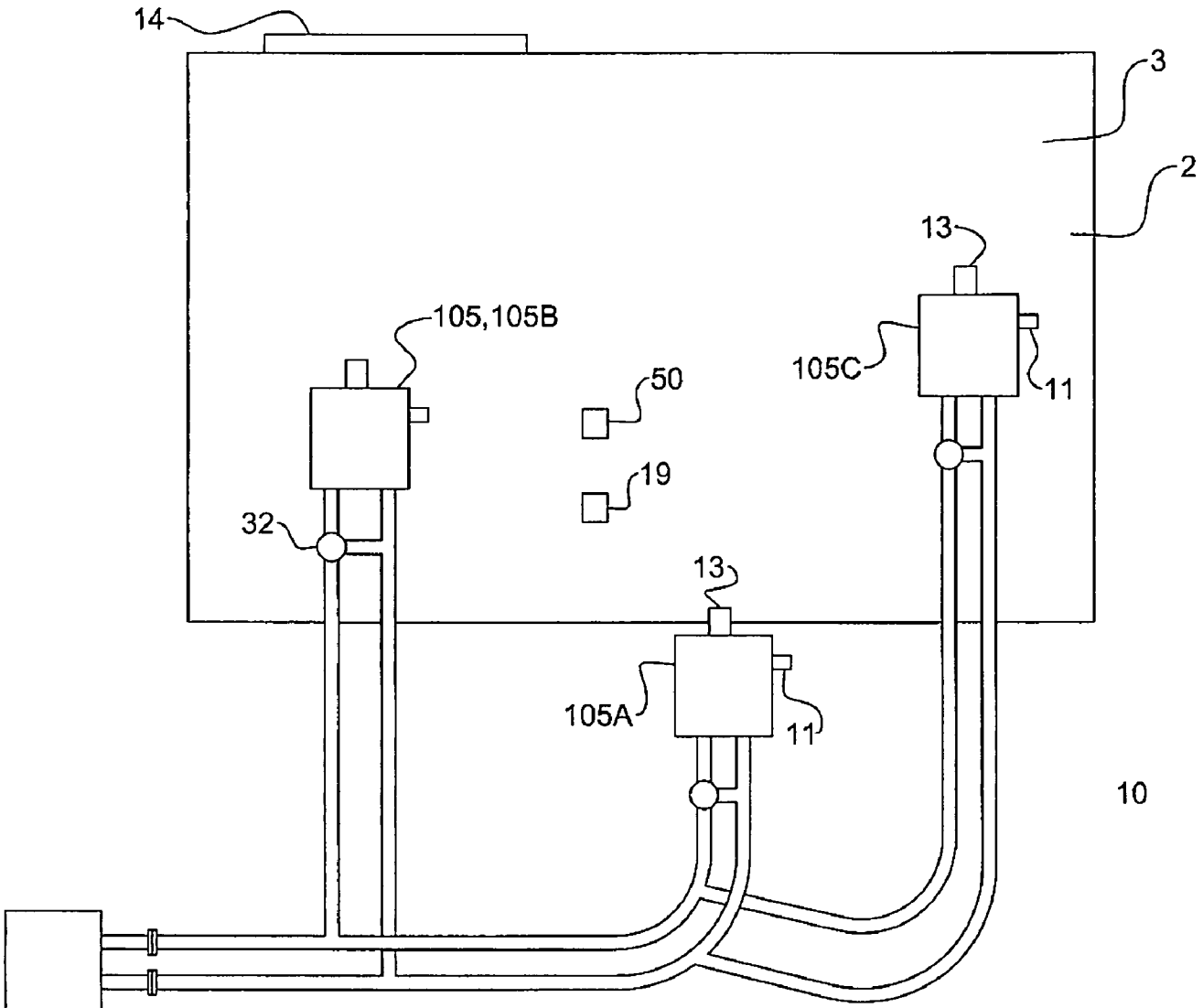
FIG. 3 is a schematic top view of a plurality of heat exchanger units of the invention set up in an enclosed space.

As illustrated in FIG. 3, a plurality of heat exchanger units 105 can be employed. Heat exchanger unit 105A is oriented with the intake 11 outside to draw in and heat outside air 10 to force wetter inside air 2 out of the enclosed space 3 through an exhaust port 14. Heat exchanger units 105B, 105C are oriented with the intake 11 inside to draw in inside air 2 to remove mold spores, and also to heat the inside air if desired. The outlets 13 on all heat exchanger units 105 are directed into the enclosed space 3.

In FIG. 3 all heat exchanger units 105 comprise a fluid coil supplied with heat from a single fluid heater 31. Heat exchanger units with electric heating elements could be used as well. Heat controls 32 operate in response to manual commands, or can be configured to respond to changes in humidity, temperature, and the like. For example the heat exchanger unit 105A could be controlled by a humidity signal from a humidity sensor 19 located in the enclosed space 3 thus controlling humidity in the enclosed space 3, and the heat exchanger units 105B, 105C could be controlled by a temperature sensor 50 to control the temperature in the enclosed space 3. A master controller can be provided to coordinate the operation of all or some of the heat exchanger units 105.

Thus the invention provides a method of reducing the relative humidity of the inside air 2 inside an enclosed space 3 comprising drawing outside air 10 from outside the enclosed space 3 to create an air stream 9 discharging into the enclosed space 3, and allowing an amount of air substantially corresponding to the air stream 9 to escape from the enclosed space 3; sensing the relative humidity of the air in at least one sensing location with a humidity sensor 19, and in response to the relative humidity sensed at the sensing location, raising the temperature of the outside air 10 drawn in as required to lower the relative humidity of the air stream 9 such that the relative humidity of the inside air 2 is substantially maintained at a desired relative humidity.

Further the air stream 9 can be purified or scrubbed by filtering the outside air with a HEPA filter 37 capable of High Efficient Particulate Attenuation to substantially remove mold spores and like bacteria and other airborne particles. In addition the method can comprise shining an ultra-violet light on the air stream to kill micro-organisms and spores in the air stream.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A method of reducing a relative humidity of inside air inside an enclosed space, the method comprising:

drawing outside air from outside the enclosed space, with a fan, through an intake opening to create an air stream and discharging the air stream through an outlet opening into the enclosed space;

allowing an amount of air substantially corresponding to the air stream to escape from the enclosed space;

sensing the relative humidity of the air in at least one sensing location;

in response to the relative humidity sensed at the at least one sensing location, operating a temperature adjusting element located in the air stream between the intake opening and the outlet opening to raise a temperature of the outside air drawn in as required to lower the relative humidity of the air stream at the outlet opening such that the relative humidity of the inside air is substantially maintained at a desired relative humidity.

2. The method of claim 1 wherein at least one sensing location is located to sense the relative humidity of the outside air.

3. The method of claim 1 wherein at least one sensing location is located to sense the relative humidity of the air stream at the outlet opening.

4. The method of claim 1 wherein at least one sensing location is located to sense the relative humidity of the inside air at a location remote from the air stream.

5. The method of claim 1 wherein the relative humidity of the inside air is substantially maintained at a desired relative humidity by raising the temperature of the outside air and adjusting a volume of the air stream.

6. The method of claim 1 further comprising purifying the air stream by filtering the outside air with a HEPA filter capable of High Efficient Particulate Attenuation to substantially remove mold spores.

7. The method of claim 1 further comprising purifying the air stream by irradiating the air stream with ultra-violet light to kill micro-organisms and spores in the air stream.

8. The method of claim 1 wherein a temperature of the inside air is controlled by heating or cooling the inside air.

9. The method of claim 8 wherein the inside air is heated or cooled by circulating the inside air through a temperature adjusting element.

10. An apparatus for reducing a relative humidity of inside air inside an enclosed space, the apparatus comprising:

a portable outside air heat exchanger unit comprising:

a fan operative to create an air stream by drawing air from an intake and discharging the air through an outlet;

a temperature adjusting element located in the air stream between the intake and the outlet;

wherein the intake is adapted to draw air from outside the enclosed space and the outlet is adapted to discharge the air stream into the enclosed space;

a heating source connectable to the heat exchanger unit and operative to supply heat energy to the temperature adjusting element in response to directions from a heat controller;

at least one humidity sensor operative to sense the relative humidity of the air in a sensing location and to send a humidity signal to the heat controller;

wherein the heat controller is operative to receive the humidity signal and change the amount of heat energy supplied to the temperature adjusting element in response to the humidity signal.

11. The apparatus of claim 10 wherein at least one sensing location is located to sense the relative humidity of the outside air.

12. The apparatus of claim 10 wherein at least one sensing location is located to sense the relative humidity of the air stream.

13. The apparatus of claim 10 wherein at least one sensing location is located to sense the relative humidity of the inside air at a location remote from the air stream.

14. The apparatus of claim 10 further comprising a HEPA filter capable of High Efficient Particulate Attenuation located such that the air stream passes through the HEPA filter.

15. The apparatus of claim 14 further comprising a coarse filter located upstream from the HEPA filter such that the air stream passes through the coarse filter prior to passing through the HEPA filter.

16. The apparatus of claim 14 further comprising an activated carbon filter located upstream from the HEPA filter such that the air stream passes through the activated carbon filter prior to passing through the HEPA filter.

17. The apparatus of claim 10 further comprising an ultra-violet light oriented to irradiate the air stream.

18. The apparatus of claim 14 further comprising an ultra-violet light source oriented to irradiate the air stream with ultra-violet light after the air stream has passed through the HEPA filter.

19. The apparatus of claim 10 further comprising a fan controller operative to change the speed of the fan to vary the volume of air in the air stream in response to the humidity signal.

20. The apparatus of claim 10 wherein the temperature adjusting element comprises an electric heating element and wherein the heating source is an electrical power outlet connectable to the electric element by a power cord.

21. The apparatus of claim 11 wherein the temperature adjusting element comprises a fluid coil and wherein the heating source is a fluid heater connectable to the fluid coil by conduits such that heated fluid flows from the fluid heater through the fluid coil and back to the fluid heater.

22. The apparatus of claim 10 wherein the temperature adjusting element comprises a fluid coil and wherein the heating source is a fluid heater connectable to the fluid coil by conduits such that heated fluid flows from the fluid heater through the fluid coil and back to the fluid heater.

23. The apparatus of claim 22 further comprising a fluid cooler connectable to the fluid coil by conduits such that cooled fluid flows from the fluid cooler through the fluid coil and back to the fluid cooler in response to directions from a cooling controller.

24. The apparatus of claim 10 further comprising a portable inside air heat exchanger unit comprising:

a fan operative to create an air stream by drawing air from an intake and discharging the air through an outlet;

an electric heating element located in the air stream between the intake and the outlet;

wherein the intake is adapted to draw air from inside the enclosed space and the outlet is adapted to discharge the air stream into the enclosed space.

25. The apparatus of claim 24 further comprising a temperature sensor operative to send a temperature signal and a temperature controller operative to receive the temperature signal, and wherein power to the electric heating element in the inside air heat exchanger unit is controlled by the temperature controller in response to the temperature signal.

26. The apparatus of claim 12 further comprising a portable inside air heat exchanger unit comprising:

a fan operative to create an air stream by drawing air from an intake and discharging the air through an outlet;

a fluid coil located in the air stream between the intake and the outlet and connectable to the fluid heater by conduits such that heated fluid flows from the fluid heater through the fluid coil and back to the fluid heater;

wherein the intake is adapted to draw air from inside the enclosed space and the outlet is adapted to discharge the air stream into the enclosed space.

27. The apparatus of claim 26 further comprising a temperature sensor operative to send a temperature signal and a temperature controller operative to receive the temperature signal, and wherein the flow of heated fluid through the fluid coil in the inside air heat exchanger unit is controlled by the temperature controller in response to the temperature signal.

28. The apparatus of claim 24 wherein the inside air heat exchanger unit further comprises a HEPA filter capable of High Efficient Particulate Attenuation located such that the air stream created by the inside air heat exchanger unit passes through the HEPA filter.

29. The apparatus of claim 28 further comprising a coarse filter located upstream from the HEPA filter in the inside air heat exchanger unit such that the air stream passes through the coarse filter prior to passing through the HEPA filter.

30. The apparatus of claim 24 further comprising an ultra-violet light oriented to irradiate the air stream in the inside air heat exchanger unit.

* * * * *